US009677833B2

(12) United States Patent
Kincel

(10) Patent No.: US 9,677,833 B2
(45) Date of Patent: Jun. 13, 2017

(54) CHARGING HANDLE WITH IMPROVED GAS DEFLECTION

(75) Inventor: Eric Kincel, Tucson, AZ (US)

(73) Assignee: Abrams Airborne Manufacturing Inc., Tucson, AZ (US)

( * ) Notice: Subject to any disclaimer, the term of this patent is extended or adjusted under 35 U.S.C. 154(b) by 49 days.

(21) Appl. No.: 13/317,196

(22) Filed: Oct. 12, 2011

(65) Prior Publication Data

US 2013/0092014 A1 Apr. 18, 2013

(51) Int. Cl.
*F41A 3/72* (2006.01)

(52) U.S. Cl.
CPC ..... *F41A 3/72* (2013.01)

(58) Field of Classification Search
CPC ..... F41A 3/12; F41A 3/72; F41A 7/00; F41A 7/02; F41A 7/04; F41A 7/06; F41A 19/34
USPC ..... 89/1.4, 1.42
See application file for complete search history.

(56) References Cited

U.S. PATENT DOCUMENTS

| | | | | | |
|---|---|---|---|---|---|
| 1,517,351 | A * | 12/1924 | Fletcher | 89/1.14 |
| 3,225,653 | A * | 12/1965 | Packard | 89/1.4 |
| 5,351,598 | A | 10/1994 | Schuetz | |
| 5,448,940 | A | 9/1995 | Schuetz | |
| 5,499,569 | A | 3/1996 | Schuetz | |
| 5,551,179 | A | 9/1996 | Young | |
| 6,311,603 | B1 * | 11/2001 | Dunlap | 89/1.4 |
| 7,231,861 | B1 * | 6/2007 | Gauny et al. | 89/1.4 |
| 7,240,600 | B1 * | 7/2007 | Bordson | 89/1.4 |
| 7,461,581 | B2 | 12/2008 | Leitner-Wise | |
| 7,707,921 | B1 * | 5/2010 | Hoel | 89/1.4 |
| 7,798,045 | B1 * | 9/2010 | Fitzpatrick et al. | 89/1.4 |
| 7,900,546 | B2 * | 3/2011 | Bordson | 89/1.4 |
| 8,209,896 | B1 * | 7/2012 | Cashwell | 42/94 |
| 2011/0214558 | A1 * | 9/2011 | Kincel | 89/1.4 |
| 2011/0226120 | A1 * | 9/2011 | Fitzpatrick et al. | 89/1.4 |

* cited by examiner

*Primary Examiner* — Bret Hayes
(74) *Attorney, Agent, or Firm* — Fay Sharpe LLP

(57) ABSTRACT

A charging handle for a firearm which has a handle portion connected to a pull rod member. A bore hole collects exhaust gases passing over the top of the rod member and directs the gases to vent tunnel(s) which extend perpendicular to the rod member. In the preferred embodiment, a deflecting surface is used to further direct the exhaust gases to the bore hole. Further embodiments provide seals to protect the user from any exhaust gas which has not been vented.

27 Claims, 6 Drawing Sheets

12A
14A
10A
16B
13A
13B
14B
12B
16A
10B
15
16C
11A
11B 21A
23
20
22
16C

CHARGING HANDLE WITH IMPROVED GAS DEFLECTION

BACKGROUND OF THE INVENTION

The invention relates generally to charging handles for firearms and more particularly to charging handles having mechanisms to minimize gas discharge affecting the user of the firearm.

For many modern firearms, a charging handle is used to engage the bolt assembly of the firearm so that a preliminary cartridge is loaded into the chamber. This charging handle is typically mounted parallel with the bolt assembly and is manually operated to pull the bolt assembly to insert the first cartridge. Once the first cartridge is loaded, the charging handle is latched to the firearm as the firing of the first cartridge produces sufficient gas pressure to load the second and subsequent cartridges.

Although the gas pressure is utilized to re-charge or reload the cartridges into the chamber, a portion of the gas is inadvertently discharged along the top of the charging handle to impact upon the shooter's face and eyes. This is uncomfortable and is additionally dangerous as unspent gun powder and embers can also be carried along with the gases into the face of the shooter.

A few charging handles have attempted to solve this problem by erecting "barriers" to divert the gas away from the face or with channels which are used to assist in re-directing the gas discharge. Unfortunately, these techniques, although reducing the amount of discharge gases impacting the user, do not reduce the amount of discharge gas to any large extent; hence, there is still an unsatisfactory level of gases being directed to the shooter's face.

It is clear from the foregoing that there is a need for improved gas deflection mechanisms for charging handles.

SUMMARY OF THE INVENTION

The invention relates to a charging handle assembly for a firearm. Those of ordinary skill in the art readily recognize the use of a charging handle. Examples of such apparatus are described in: U.S. Pat. No. 5,351,598, entitled "Gas-Operated Rifle System" issued to Schuetz on Oct. 4, 1994; U.S. Pat. No. 5,448,940, entitled "Gas-Operated M16 Pistol" issued to Schuetz et al. on Sep. 12, 1995; U.S. Pat. No. 5,551,179, entitled "Bolt Carrier" issued to Young on Sep. 3, 1996; U.S. Pat. No. 5,499,569, entitled "Gas-Operated Rifle System" issued to Schuetz on Mar. 19, 1996; and, U.S. Pat. No. 7,461,581, entitled "Self-Cleaning Gas Operating System for a Firearm" issued to Leitner-Wise on Dec. 9, 2008, all of which are incorporated hereinto by reference.

This invention relates to a charging handle for a firearm which has a handle portion connected to a pull rod member. A bore hole collects exhaust gases passing over the top of the rod member and directs the gases to vent tunnel(s) which extend perpendicular to the rod member. In the preferred embodiment, a deflecting surface is used to further direct the exhaust gases to the bore hole. Further embodiments provide seals to protect the user from any exhaust gas which has not been vented.

The invention produces a charging handle for a firearm. The charging handle consists of a handle portion connected to a pull rod member where a catch mechanism is positioned at the proximal end of the charging handle to engage the action of the firearm.

During discharge of the firearm, a certain amount of exhaust passes over the top of the pull rod. This exhaust gas is directed to a bore hole which communicates to at least one vent tunnel located within the handle. The vent tunnel directs the exhaust gas from the bore hole perpendicular to the rod member, and away from the user's face.

The charging handle in the preferred embodiment includes a deflecting surface positioned to direct gases flowing down a top of said rod member to said bore hole.

The preferred deflecting surface is employed to further protect the user and also to encourage the exhaust gas into the bore hole. The ideal deflecting surface is sloped downward towards the top of the handle and forms a semi-circle around said bore hole.

In another embodiment, a pliable seal is used to seal the top of the pull rod to the to the action mechanism. This seal also directs the exhaust gas to the bore hole so that the gases are not passed through to the user's face.

This preferred seal arrangement uses a recess positioned in a top surface of the handle portion with a pliable seal secured within the recess. This pliable seal extends above the top surface of said handle portion to contact the action mechanism when the charging handle is at rest.

Another seal of the present invention is optionally placed between the deflecting handle and the action mechanism to form a tighter seal and further encourage the exhaust gases from impacting the user.

While the preferred embodiment uses a semi-circular deflecting surface, another embodiment uses two "wall" sections positioned on the handle itself to direct any escaping exhaust gas away from the user.

In some embodiments, the vent tunnel extends across the entirety of said handle portion to exhaust gases in both lateral directions, not into the face of the user.

The vent tunnels in one embodiment communicate with a spring recess in said handle portion. This spring recess is used with the locking mechanism for the charging handle and encourages the locking mechanism to stay in a locked position.

The invention, together with various embodiments thereof will be more fully explained by the accompanying drawings and the following descriptions thereof.

DRAWINGS IN BRIEF

FIGS. 1A, 1B, and 1C illustrate the preferred embodiment of the invention.

DRAWINGS IN DETAIL

Figure 14:
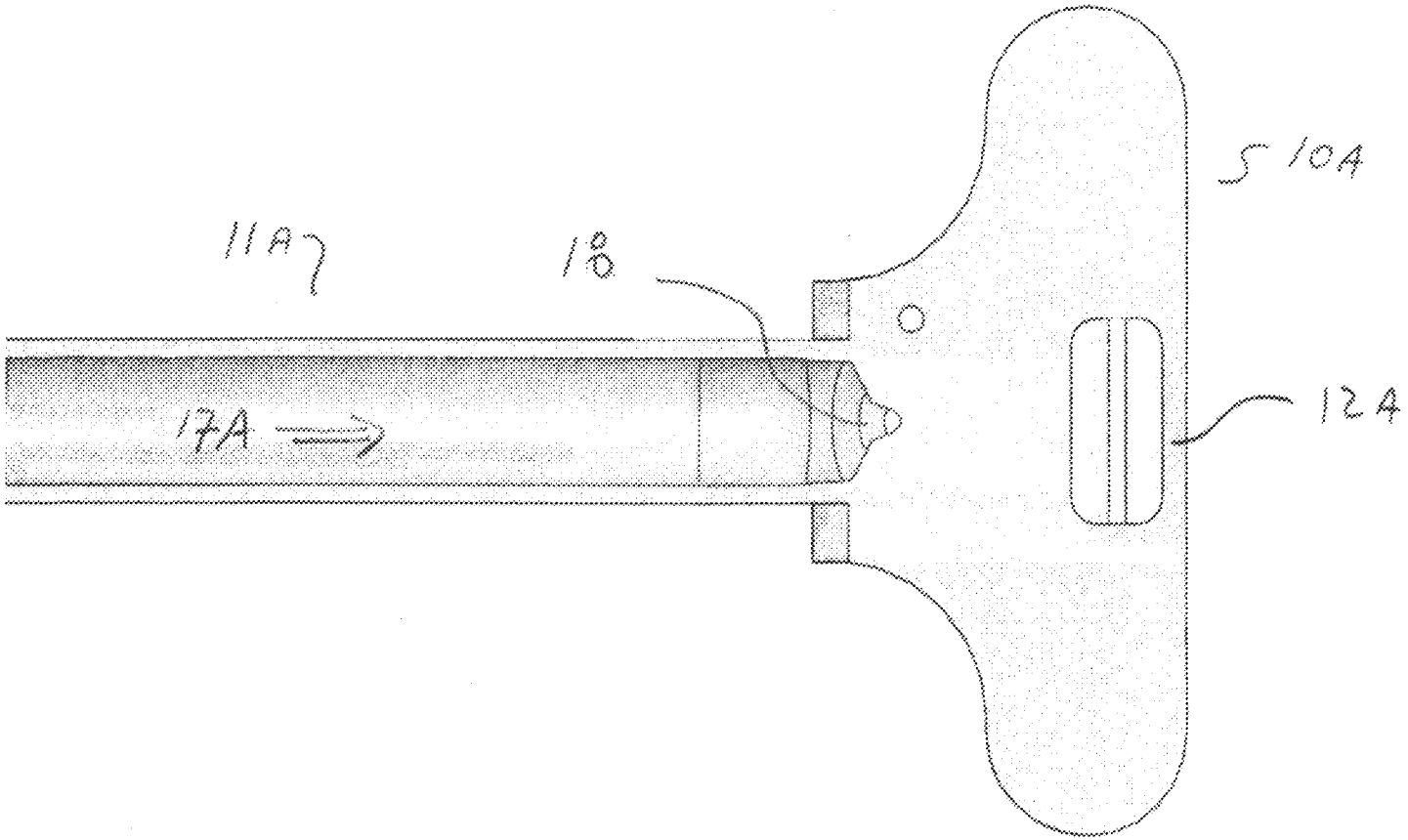
Figure 1B:
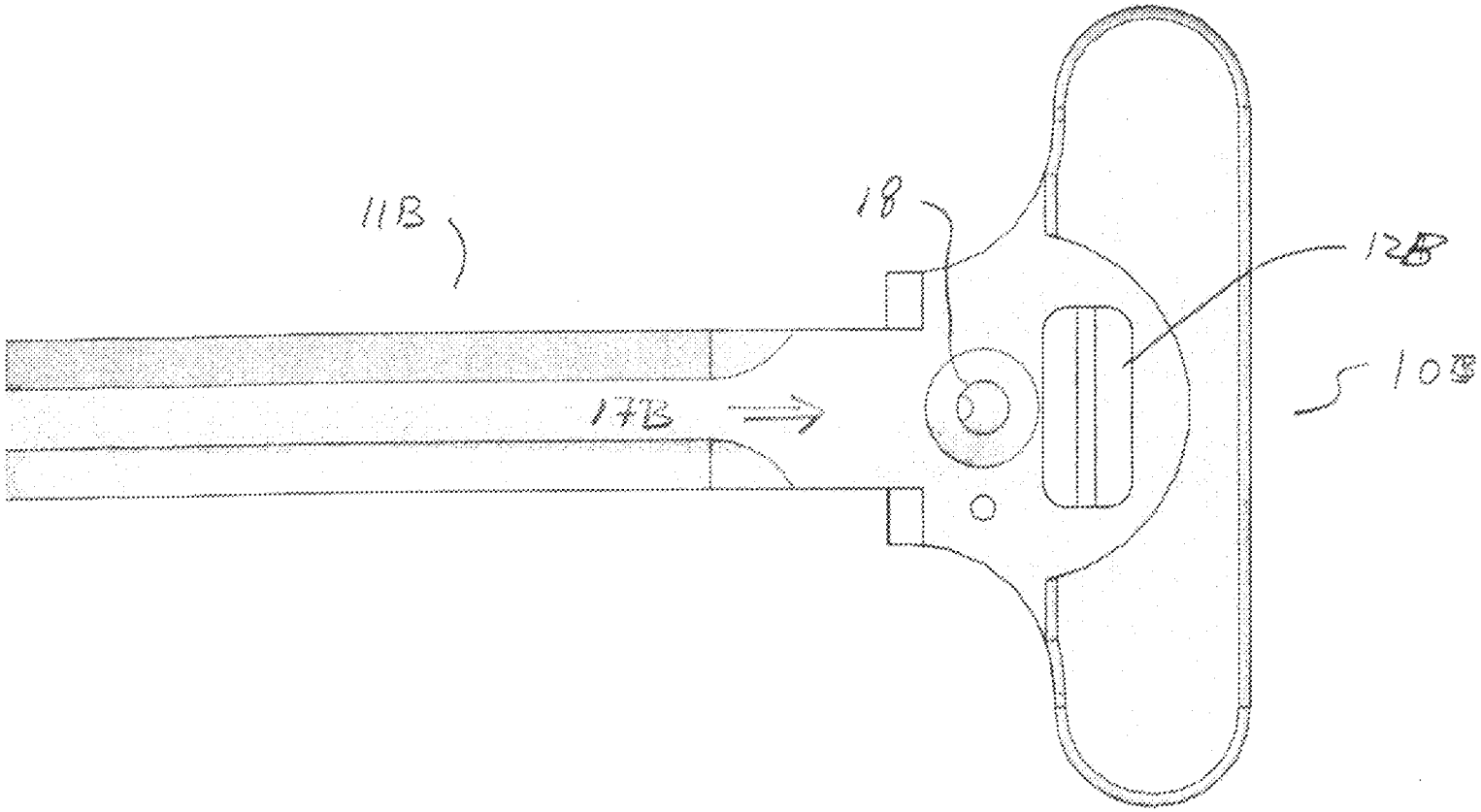
Figure 1C:
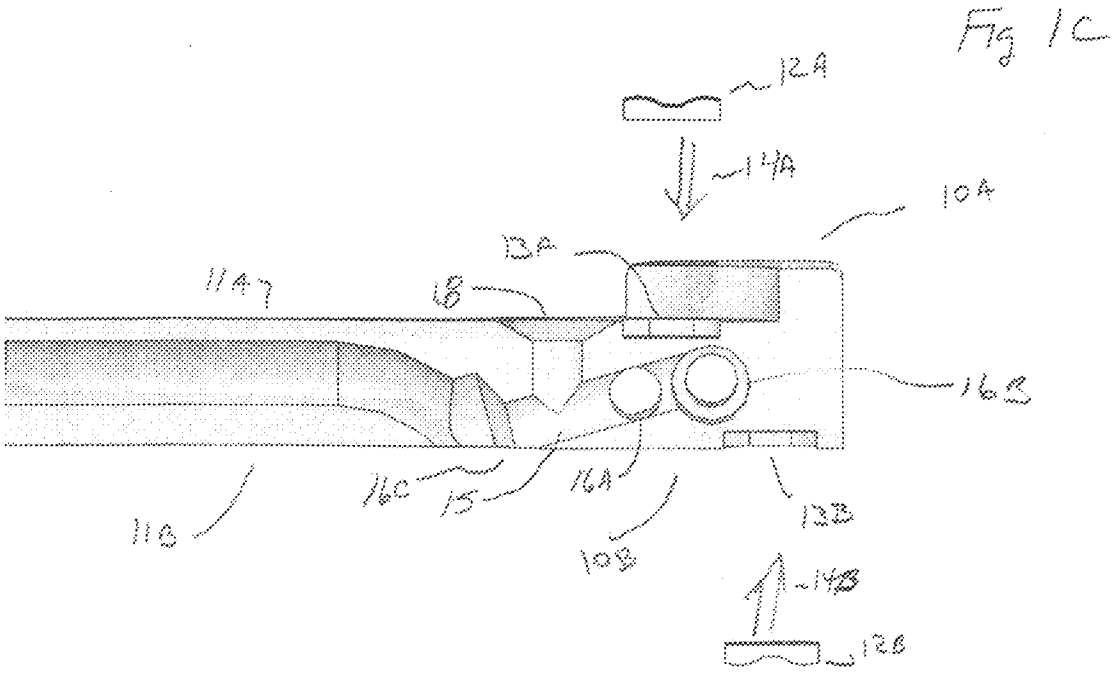

FIGS. 1A, 1B, and 1C illustrate the preferred embodiment of the invention. FIG. 1A is a bottom view of the preferred charging handle; FIG. 1B is a top view of the preferred charging handle, and FIG. 1C illustrates the application of the seals to the charging handle.

The charging handle consists of a handle portion 10A/10B connected to a pull rod member 11A/11B. During discharge of the firearm, a certain amount of exhaust passes across the bottom of the pull rod 11A as illustrated by arrow 17A. This exhaust gas 17A is directed to a bore hole 18 which communicates with vent 15 and then to exhaust vents 16A, 16B, and 16C. Exhaust vents 16A and 16B direct the exhaust gas perpendicular to pull rod 11A/11B, avoiding the user's face. Exhaust vent 16C discharges the exhaust gas downward and away from the user's face.

In this fashion, exhaust gases 17B are directed to vent 18 which communicates the exhaust gases 17B safely away from the user.

This charging handle also includes seals 12A and 12B which are secured into recesses 13A and 13B respectively as illustrated by arrows 14A and 14B. Seals 12A and 12B engage the action mechanism body to further protect the user's face.

The exhaust vent tunnels in one embodiment communicate with a spring recess 16B (spring is not shown for clarity) in said handle portion. This spring recess 16B contains the spring used with the locking mechanism for the charging handle (not shown for simplicity purposes).

In another embodiment of the invention, the vent tunnels extend across the entirety of the handle portion 10A/10B.

Figure 2A:
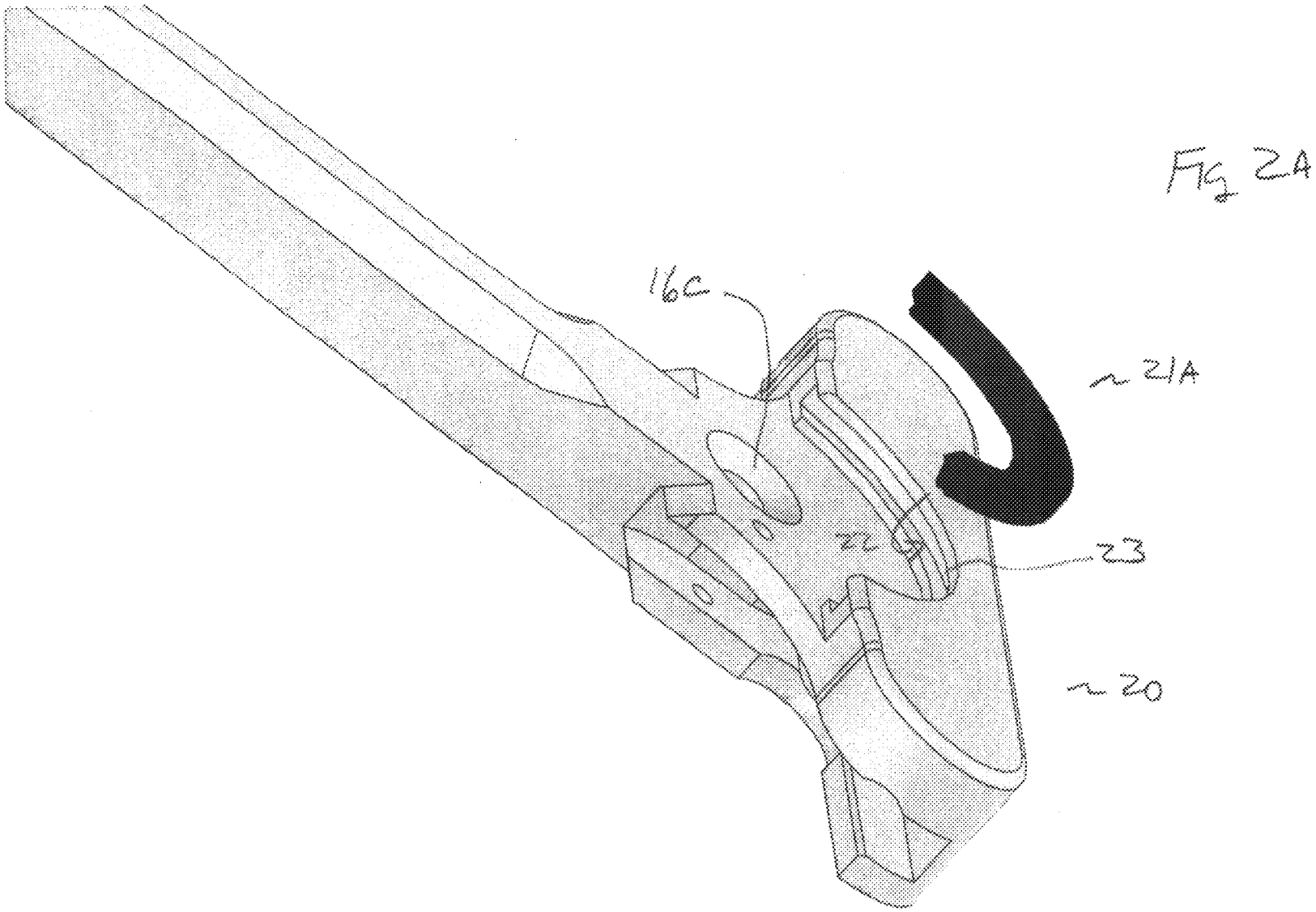
FIGS. 2A and 2B illustrate an alternative embodiment's sealing mechanism.
Figure 2B:
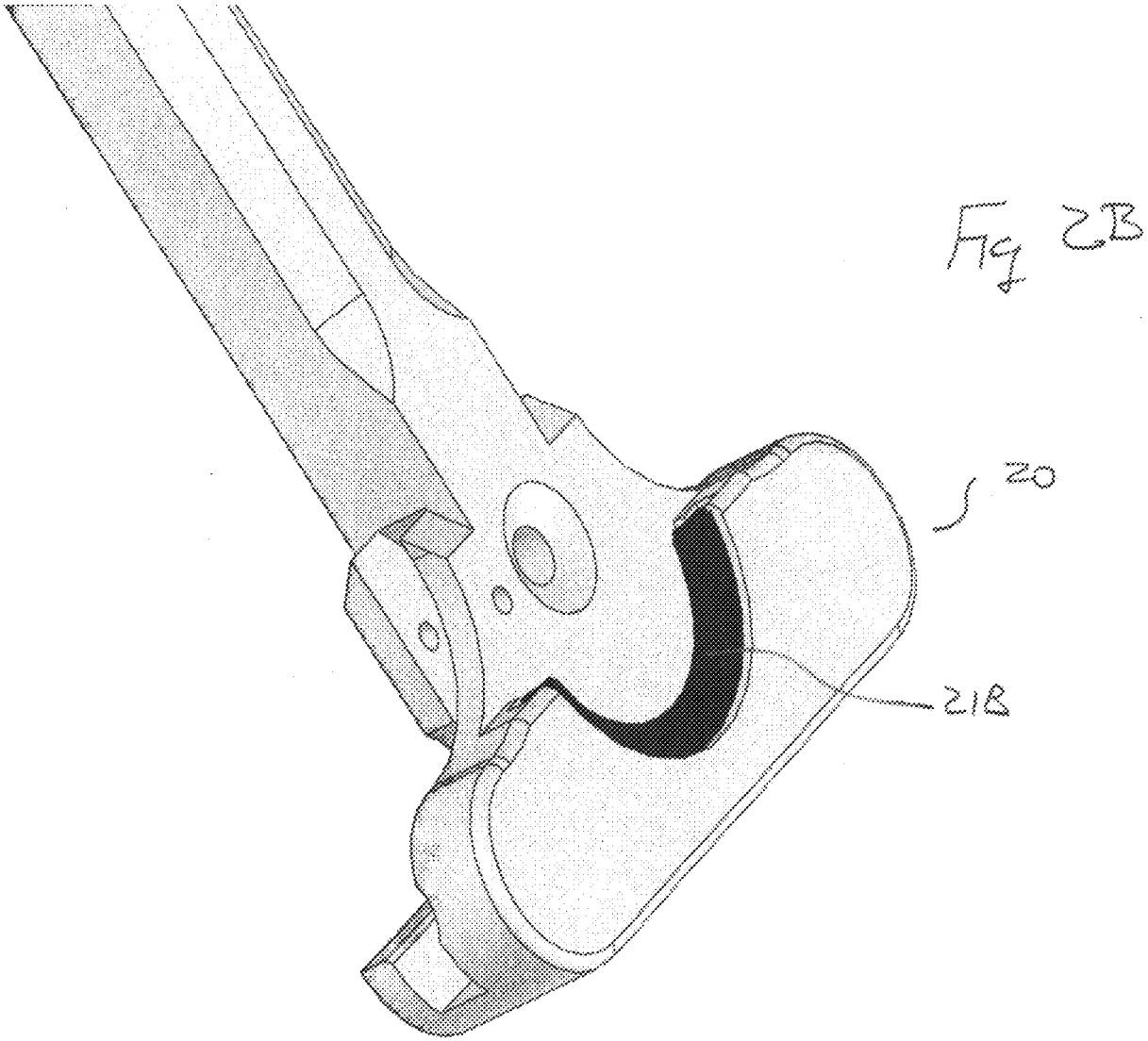

FIGS. 2A and 2B illustrate an alternative embodiment's sealing mechanism.

On the handle portion 20, a deflecting surface 23 is also employed to further protect the user and also to encourage the exhaust gas into the bore hole 16C. In one embodiment, the deflecting surface 23 is sloped downward towards the top of the handle and forms a semi-circle around the vent 18.

For further affect, a pliable seal 21A is secured to the deflecting surface 23 as illustrated by arrow 22, as shown by seal 21B. Seal 21B also directs the exhaust gas to the bore hole 12 so that the gases are not passed through to the user's face.

While the preferred embodiment uses a semi-circular deflecting surface, another embodiment uses two "wall" sections positioned on the handle itself to direct any escaping exhaust gas away from the user.

Figure 3:
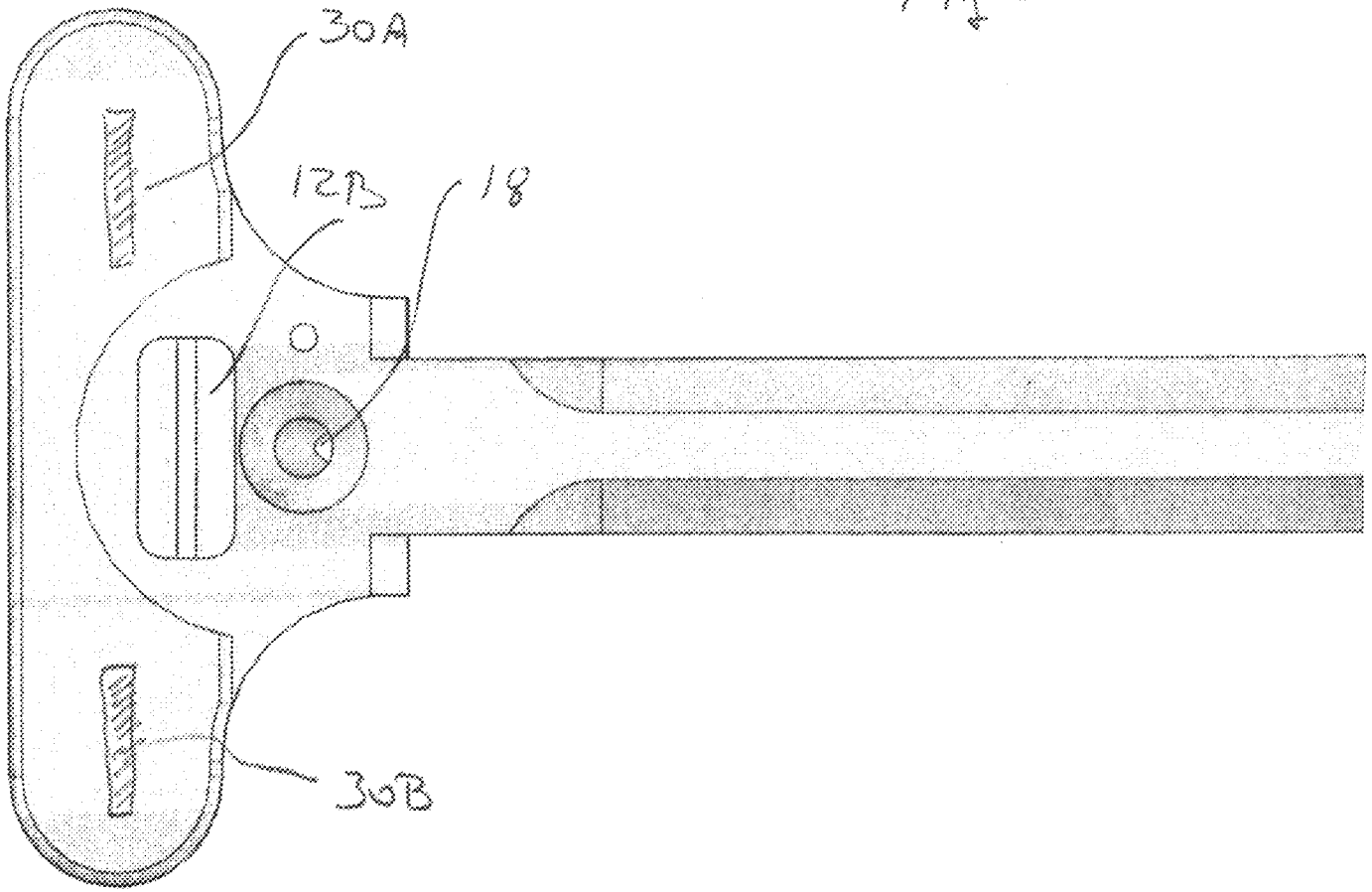
FIG. 3 illustrates the placement of the deflecting walls in one embodiment of the invention.

FIG. 3 illustrates the placement of the deflecting walls in one embodiment of the invention.

Deflecting walls 30A and 30B are raised portions which assist in deflecting any exhaust gases that are not blocked by seals 12B or exhausted via vent 18.

It is clear that the present invention provides a highly improved charging handle which provides for efficient gas discharge diversion away from the user's face.

What is claimed is:

1. A charging handle for an associated firearm that is operative to generate associated discharge gases, said charging handle comprising:

a pull rod member having a centerline and extending lengthwise between a proximal end and a distal end with a top surface extending along said pull rod member between said proximal and distal ends;

a handle portion disposed along said proximal end of said pull rod member;

at least one vent tunnel in said handle portion, said vent tunnel being substantially perpendicular to said centerline of said rod member; and, a bore hole disposed along one of said handle portion and said proximal end of said pull rod member, said bore hole disposed in fluid communication with said at least one vent tunnel and dimensioned to direct associated discharge gases from along said top surface of said pull rod member into said at least one vent tunnel.

2. The charging handle according to claim 1 further comprising a deflecting surface positioned to direct associated discharge gases flowing along said top surface of said pull rod member toward said bore hole.

3. The charging handle according to claim 2, wherein said deflecting surface is sloped downward to a top surface of said handle portion.

4. The charging handle according to claim 2, wherein said deflecting surface forms a semi-circle around said bore hole.

5. The charging handle according to claim 2 further comprising a pliable seal connected to deflecting surface.

6. The charging handle according to claim 2, wherein said handle portion includes wings extending outwardly in opposing directions from along said centerline, and said deflecting surface includes two sections positioned along said wings of said handle portion.

7. The charging handle according to claim 2 further comprising:

a recess positioned in a top surface of said handle portion; and, a pliable seal secured within said recess and extending above said top surface of said handle portion.

8. The charging handle according to claim 2, wherein said at least one vent tunnel extends across the entirety of said handle portion.

9. The charging handle according to claim 8, wherein one of said at least one vent tunnel communicates with a spring recess in said handle portion.

10. The charging handle according to claim 9 further comprising:

a locking mechanism secured to said handle portion, said locking mechanism adapted to selectively lock said charging handle to an associated action of the associated firearm; and, a spring positioned within said spring recess such that said spring encourages said locking mechanism to be in a locked position.

11. An action assembly for an associated firearm having an associated barrel for discharging an associated bullet, said action assembly comprising:

an action mechanism adapted to place an associated bullet in line with the associated barrel in preparation for discharge; and, a charging handle operatively engaged with the action mechanism, said charging handle including:

a pull rod member extending in a lengthwise direction between proximal and distal ends with said distal end of said pull rod member configured to engage the action mechanism to place an associated bullet in line with the associated barrel in preparation for discharge;

a handle portion disposed along said proximal end of said pull rod member;

at least one vent tunnel in said handle portion, said at least one vent tunnel being substantially perpendicular to said lengthwise direction of said pull rod member; and, a bore hole disposed along one of said handle portion and said proximal end of said pull rod member proximate to said handle portion, said bore hole disposed in fluid communication with said at least one vent tunnel and dimensioned to direct associated discharge gases from along a top surface of said pull rod member into said at least one vent tunnel.

12. An action assembly according to claim 11, wherein said charging handle includes a deflecting surface positioned to direct gases flowing down said top surface of said pull rod member toward said bore hole.

13. An action assembly according to claim 12, wherein said deflecting surface is sloped downward toward a top surface of said handle portion.

14. An action assembly according to claim 13, wherein said charging handle includes a pliable seal disposed along said deflecting surface.

15. An action assembly according to claim 12, wherein said deflecting surface forms a semi-circle around said bore hole.

16. An action assembly according to claim 12, wherein said handle portion includes wings extending outwardly transverse to said longitudinal direction, and said deflecting surface includes two sections with one section positioned along each of said wings of said handle portion.

17. An action assembly according to 11, wherein said charging handle further includes:

a recess positioned in a top surface of said handle portion; and, a pliable seal secured within said recess and extending above said top surface of said handle portion.

18. An action assembly according to claim 11, wherein said at least one vent tunnel of said charging handle extends across the entirety of said handle portion.

19. An action assembly according to claim 11, wherein said handle portion includes a spring recess, and said at least one vent tunnel communicates with said spring recess in said handle portion.

20. An action assembly according to claim 19, wherein said charging handle further includes:

a locking mechanism secured to said handle portion, said locking mechanism adapted to selectively lock said charging handle to said action mechanism; and, a spring positioned within said spring recess such that said spring encourages said locking mechanism to be in a locked position.

21. A charging handle for an associated firearm that has an associated action mechanism and that is operative to generate associated discharge gases, said charging handle having a first side and a second side opposite said first side, and said charging handle comprising:

a pull rod member extending in a lengthwise direction between a proximal end and a distal end;

a handle portion disposed along said proximal end of said pull rod member;

a first recess extending into one of said pull rod member and said handle portion from along a first surface disposed along said first side of said charging handle; and, a first pliable seal disposed along one of said handle portion and said proximal end of said pull rod member on said first side of said charging handle, said first pliable seal received within said first recess such that a portion of said first pliable seal extends outward beyond said first surface and is dimensioned to operatively engage the associated action mechanism and thereby at least partially deflect associated discharge gases flowing in said lengthwise direction toward said handle portion.

22. A charging handle according to claim 21, wherein said charging handle includes a second pliable seal disposed along said second side of said charging handle.

23. A charging handle according to claim 22, wherein said charging handle includes a second recess extending into one of said pull rod member and said handle portion from along a second surface disposed along said second side, and said second pliable seal received within said second recess such that a portion of said second pliable seal extends outward beyond said second surface on said second of said charging handle.

24. A charging handle according to claim 21 further comprising a deflecting surface disposed along one of said pull rod member and said handle portion, said deflecting surface positioned to at least partially deflect associated discharge gases flowing in said lengthwise direction toward said handle portion.

25. A charging handle according to claim 24, wherein said first pliable seal is operatively disposed along said deflecting surface.

26. A charging handle according to claim 25, wherein said deflecting surface has a curvilinear shape, and said first pliable seal projects inwardly beyond said deflecting surface.

27. A charging handle according to claim 24, wherein said deflecting surface is a first deflecting surface disposed along said handle portion, and said charging handle further comprises a second deflecting surface disposed along said handle portion in spaced relation to said first deflecting surface.

* * * * *